United States Patent [19]

Jerome

[11] 4,207,954

[45] Jun. 17, 1980

[54] CORE BIT HAVING AXIAL CONICAL CORE BREAKER

[75] Inventor: Robert Jerome, Brussels, Belgium

[73] Assignee: Compagnie Francaise des Petroles, Paris, France

[21] Appl. No.: 892,357

[22] Filed: Mar. 31, 1978

[30] Foreign Application Priority Data

Mar. 31, 1977 [FR] France ..... 77 09825

[51] Int. Cl.[2] ..... E21B 9/16

[52] U.S. Cl. ..... 175/330; 175/391; 175/404

[58] Field of Search ..... 175/329, 330, 391, 403, 175/404, 405

[56] References Cited

U.S. PATENT DOCUMENTS

| | | | |
|---|---|---|---|
| 2,731,236 | 1/1956 | Bruce | 175/330 |
| 2,738,166 | 3/1956 | Koch | 175/330 |
| 2,975,849 | 3/1961 | Stuart | 175/330 X |
| 3,055,443 | 9/1962 | Edwards | 175/330 |
| 3,112,800 | 12/1963 | Bobo | 175/403 X |
| 3,158,216 | 11/1964 | Baron et al. | 175/403 X |
| 3,768,581 | 10/1973 | Rederon | 175/329 |
| 3,845,830 | 11/1974 | Fowler et al. | 175/404 |
| 3,861,478 | 1/1975 | Condolios et al. | 175/404 |

FOREIGN PATENT DOCUMENTS

| | | | |
|---|---|---|---|
| 1226962 | 10/1966 | Fed. Rep. of Germany | 175/330 |

*Primary Examiner*—Ernest R. Purser
*Assistant Examiner*—Nick A. Nichols, Jr.
*Attorney, Agent, or Firm*—Sughrue, Rothwell, Mion, Zinn and Macpeak

[57] ABSTRACT

A drilling tool comprising a body having a leading face with a central recess providing the body with an annular leading cutting edge such that during drilling a central core is formed, and a central cone positioned axially in the recess for breaking up the core.

9 Claims, 3 Drawing Figures

CORE BIT HAVING AXIAL CONICAL CORE BREAKER

The present invention relates to drilling tools and especially to high output drilling tools of the type with set-in or moulded cutters carrying stepped blocks, preferably diamond-covered and designed to destroy the drill-cores during formation and increase the output.

Numerous types of tools which comprise means intended to remove the drill-cores being formed are known. A large number of these permit the drill-core to develop over a certain length so that it can then be destroyed more conveniently.

Thus there may be mentioned, amongst the numerous devices for attacking a drill-core, those tools which comprise, at the center, a passage of relatively large length compared to the total height of the tool, terminating, at the level at which the debris is removed, in a punch which is conical and does not rotate relative to the drill-core, the purpose of the punch being to cause the drill-core to break up when it comes into contact with the punch.

In spite of the advantages which such a tool offers, its use can cause certain difficulties, depending on the rocks encountered, due to abrupt breaks, causing the danger of choking which is the more troublesome the faster is the rate of advance of the tool, and the larger, relatively, are the sizes of the pieces of drill-core.

It is an object of the present invention to provide a drilling tool with means for attacking the drill-core, wherein the attack takes place by means of a drilling cone located in the central part of the tool, so that the drill-core exhibits, at its apex, a conical cavity formed by rotation of the central attack cone of the tool.

It is a further object of the invention to provide a drill tool in which, to assist the removal of debris including that formed in the attack zone external to the central zone, drilling sludge is caused to converge in the central zone and to be discharged solely downstream from the central attack cone.

In this way, flushing appropriate to the small size of the attack elements of the central cone is achieved, regardless of the type of central drilling cone used.

It is a further object of the invention to provide, at the apex of the cone, a diamond which serves as a pivot for the drilling cone and assists the breaking up of the rock into small pieces by a punching action, the cutting and/or abrasion being effected by cutting elements distributed over the surface of the cone.

Experience has shown that the speed of advance achieved is increased without danger of graphitisation of the diamond, since the latter has a surface velocity of zero and is copiously swept by the sludge.

Furthermore, the breaking up of the drill-core into small pieces under the action of the diamond pivot is facilitated by the decompression which takes place at the peripheral parts of the drill-core because of the conventional attack of this periphery by cutting elements on the internal surface of the tool body.

The invention will be more fully understood from the following description of an embodiment thereof, given by way of example only, with reference to the accompanying drawings.

Figure 1:
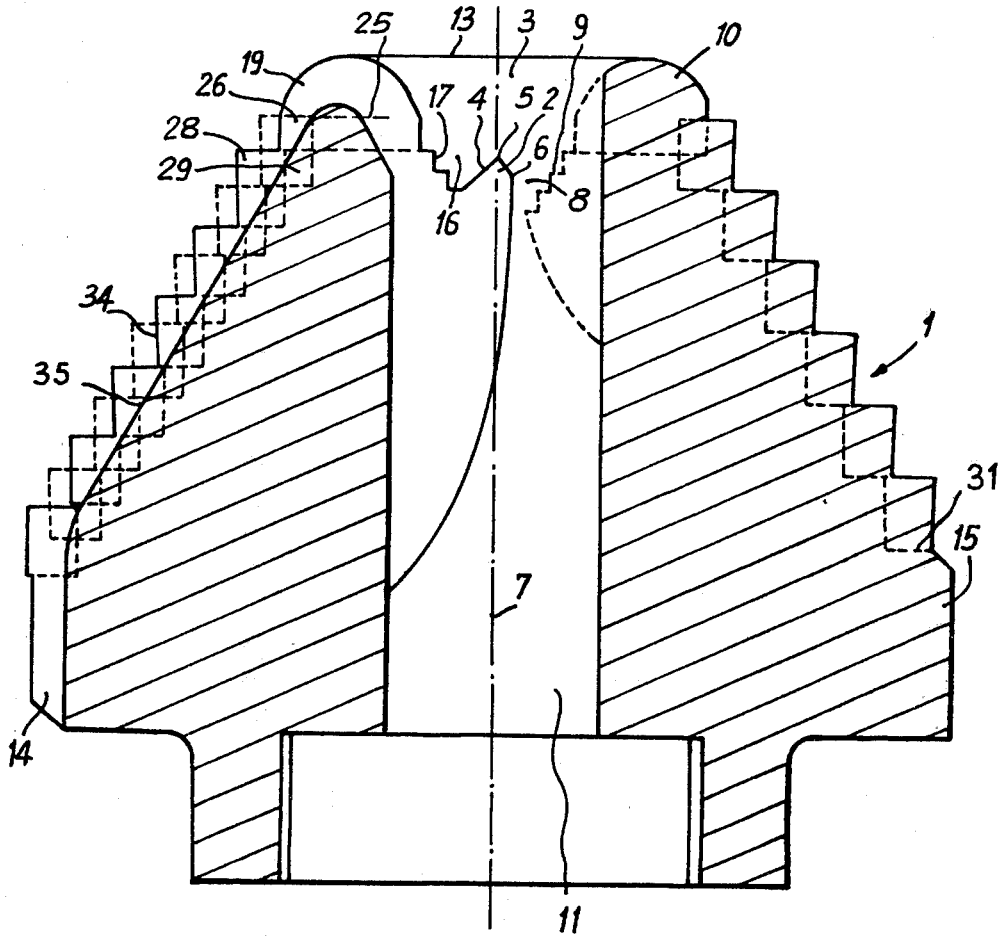
FIG. 1 is a schematic representation, in elevation and in axial cross-section, of an embodiment of a drilling tool according to the invention.

While the invention is applicable to all types of drilling tools in which rotation of the tool causes the formation of a drill-core which it is desired to destroy so that only debris of small size results, FIG. 1 shows a very high output tool 1 to which the invention is particularly applicable.

The tool 1 has an annular leading cutting edge 13 centred on the axis of rotation of the tool and surrounding a central recess in which a cone 2 is provided for drilling the drill core formed by the annular cutting edge 13. The cone 2 can be produced, and incorporated into the tool, by any known technique. It can thus be moulded or set-in, and can be produced by simple sintering with or without infiltration. The cutting edges on the surface of the cone 2 are shown schematically by the profile 4, though the purpose of this line is only to act as a reminder that the cone 2 is a drilling cone, of which the nature and structure depend on the nature of the ground which is to be drilled. Thus, the cone 2 may comprise a diamond-dust concretion or can have diamonds set in over all or parts of its surface, which surface may optionally comprise cutters into which diamonds or a diamond-dust concretion are incorporated.

Figure 2:
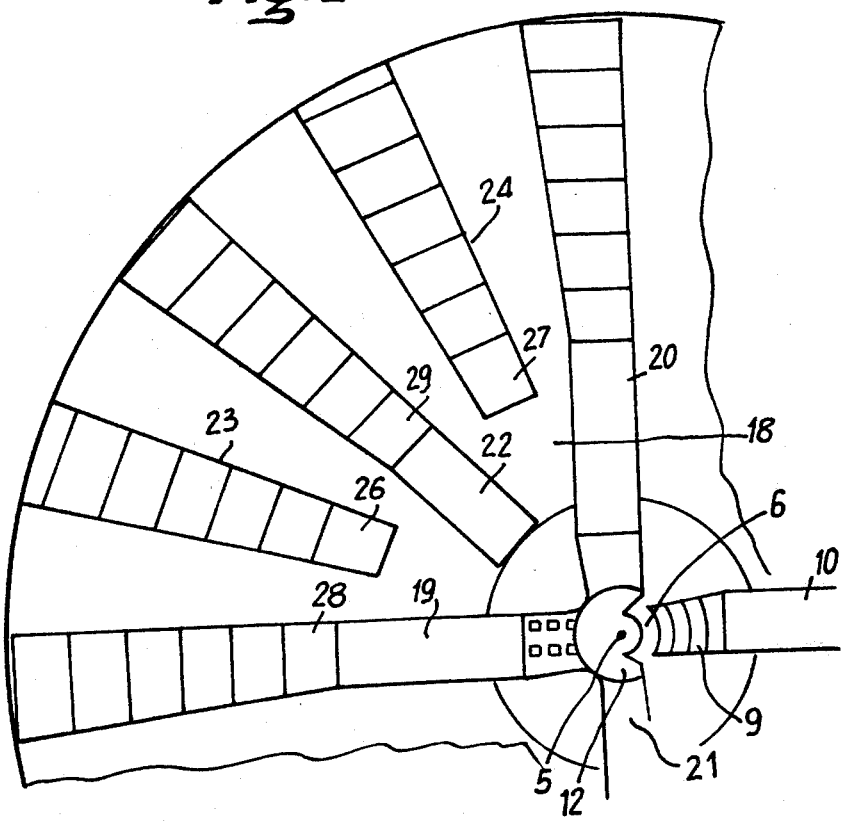
FIG. 2 is a schematic plan view of the end of the tool of FIG. 1.
Figure 3:
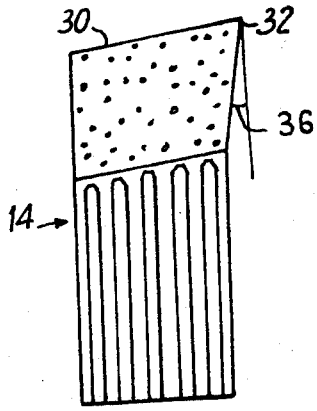
FIG. 3 is an elevational view of two peripheral cutters of the tool of FIG. 1.

Preferably, the point of the cone 2 carries a diamond 5, whether the cone is a cone with cutters or the cone with set-in diamonds shown in FIG. 2. Orifices for sludge coming from passages such as passage 11 are located at the level of the base of the cone 2, so that the sludge flushes the whole of the surface of the cone 2 and of the inner active part of the tool, and then flows beyond the leading cutting end 13 of the tool and rises to the surface after passing over the peripheral cutters 14 and 15 of the tool. In this embodiment, the cone 2 is cut away at 6 on one side of the axis 7, so as to leave a free space 8 opposite attacking teeth 9 of the opposite cutter 10, communicating with passage 11 to facilitate the flow of the sludge.

The apex of the cone, with its diamond 5, is located on the axis 7 of the tool and of the drill-core which is being formed. In this way, the base of the drill-core, which extends from the end 13 of the tool to the diamond 5, and which is already under less pressure then the ground below it as a result of the lateral and frontal attack of the edges of the drilling cutters 9, terminates in a zone 16 which is under intense decompression due to the attack of the internal drilling cutters 9 and the cutting surface 4 of the cone 2. This decompression is the greater, the more the cone 2 in this region presses on the pivot diamond 5, facilitating, through a punching action on the central part of the drill-core, the work of the other diamonds and of the edges of the surfaces 4, 9 and 17. It is self-evident that, depending on the type of tool used, the level of the cone diamond 5 can vary relative to the levels of the attacking cutters, but the cone diamond should at all times remain at a level which is sufficiently close to the end 13 of the tool that the length of the drill-core never exceeds the height of the active part of the tool, i.e. the height over which the sets of cutting surfaces of the tool extend.

It will be noted that, in the embodiment described, broad zones 18 have been provided without cutters near the leading end 13 of the tool, so as to provide a large free volume for debris and sludge. Thus, the ends of the cutters such as 10, 19, 20 and 21 are at the level of the end 13, whilst the ends of the cutters such as 22 are at a level 25, which is itself higher than the level of the ends 26 and 27 of the cutters 23 and 24. This staggering furthermore results in staggering of the levels of the cutting edges of consecutive cutters, as can be seen by considering, for example, the edges 28, 26 and 29 as well as the peripheral cutters 14.

The cutting surfaces 30 and 31, of different levels of cutters, have a slope which makes it easy to remove the decompressed debris after it has passed over the cutting edges 32. Equally, a certain rake angle 36 is provided on the front faces relative to the direction of rotation of the cutters. These features, combined with the peripheral passages, such as those formed between the cutters and the sides 35 of the tool, contribute to increasing the total output of the tool. The attacking cone 2, as well as every other part of the tool, can contain set-in diamonds, diamond-dust concretions or pellets of tungsten carbide or of any other abrasion-resistant metal carbide.

There is thus provided a particularly efficient tool for carrying out rapid drilling to a very great depth, without having to lift the tool out.

What is claimed is:

1. An earth drilling bit, comprising:

(a) a rotatable, generally cylindrical body member having an axial passage therethrough for drilling sludge or the like and an annular cutting surface on a leading end thereof, whereby a central core is formed during drilling which extends into the axial passage, and (b) a cone-shaped drilling member integral with and made of primarily the same material as the body member, disposed within the axial passage, axially aligned with said passage, and having its apex directed toward the leading end of the body member, whereby said cone-shaped drilling member extends into, breaks up and cuts away the central core as it enters the axial passage.

2. A bit as claimed in claim 1, wherein a free space is provided at the base of said cone-shaped drilling member for assisting passage of sludge from the center of said body member to the periphery thereof.

3. A bit as claimed in claim 1, where the surface of said cone-shaped drilling member comprises pellets of abrasion-resistant material.

4. A bit as claimed in claim 1, wherein the body member is provided with a staggered array of cutters arranged with a raked clearance angle.

5. An earth drilling bit as claimed in claim 1, wherein a plurality of spaced cutter teeth rows are provided on said body member and extend around said leading end and into said axial passage, and said cone-shaped drilling member is disposed at the intersection of said rows and upstands therefrom.

6. A bit as claimed in claim 1, including a diamond mounted in the apex of said cone-shaped drilling member.

7. A bit as claimed in claim 6, wherein the lateral surfaces of said cone-shaped drilling member comprise cutting diamonds distributed around said apex diamond.

8. A bit as claimed in claim 1, further comprising active cutting means disposed on the body member and extending into the axial passage to a predetermined depth, and wherein the apex of said cone-shaped drilling member is axially spaced from said annular cutting surface of said body member a distance less than said predetermined depth.

9. A bit as claimed in claim 8, wherein said active cutting means are in a central zone of said body member opposite the lateral surfaces of said cone-shaped drilling member, whereby the part of the core located near the base of said cone is under decompression relative to the pressure in the earth.

* * * * *